US006364246B1

(12) United States Patent
Huang

(10) Patent No.: US 6,364,246 B1
(45) Date of Patent: Apr. 2, 2002

(54) LOADING WHEEL FOR INTEGRATED CIRCUIT PACKING BAND

(76) Inventor: Tzung-Lin Huang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/474,258

(22) Filed: Dec. 29, 1999

(51) Int. Cl.[7] ..... B65H 75/14
(52) U.S. Cl. ..... 242/608.5; 403/348
(58) Field of Search ..... 242/600, 607, 242/605, 608, 608.2, 608.5, 608.6; 403/348, 349, 350; 24/260, 261, 262, 488, 522, 588, 598.1, 598.4

(56) References Cited

U.S. PATENT DOCUMENTS 4,266,738 A * 5/1981 Nakagawa ..... 242/74.1
4,289,282 A * 9/1981 Kohno ..... 242/71.8
5,524,850 A * 6/1996 Liao ..... 242/608.6
5,779,186 A * 7/1998 Bakker et al. ..... 242/609.1
5,803,401 A * 9/1998 Matsuzoe ..... 242/608.5
5,950,962 A * 9/1999 Cheng ..... 242/608.5
6,089,500 A * 7/2000 Hafner ..... 242/608.5
6,182,922 B1 * 2/2001 Kazama ..... 242/608.6

* cited by examiner

*Primary Examiner*—Donald P. Walsh
*Assistant Examiner*—Mark J. Beauchaine
(74) *Attorney, Agent, or Firm*—A & J

(57) ABSTRACT

The present invention relates to a loading wheel for integrated circuit packing band, comprising a wheel body and two side plates, wherein two side plates are engaged to the wheel body at the side thereof, a plurality of protruded blocks are provided in circular along the lateral surface of the wheel body having a mounting slot. An engaging slot is provided to the side plates, and one side of the engaging slot is provided with a protruded engaging block which is engageable with the engaging slot.

1 Claim, 6 Drawing Sheets

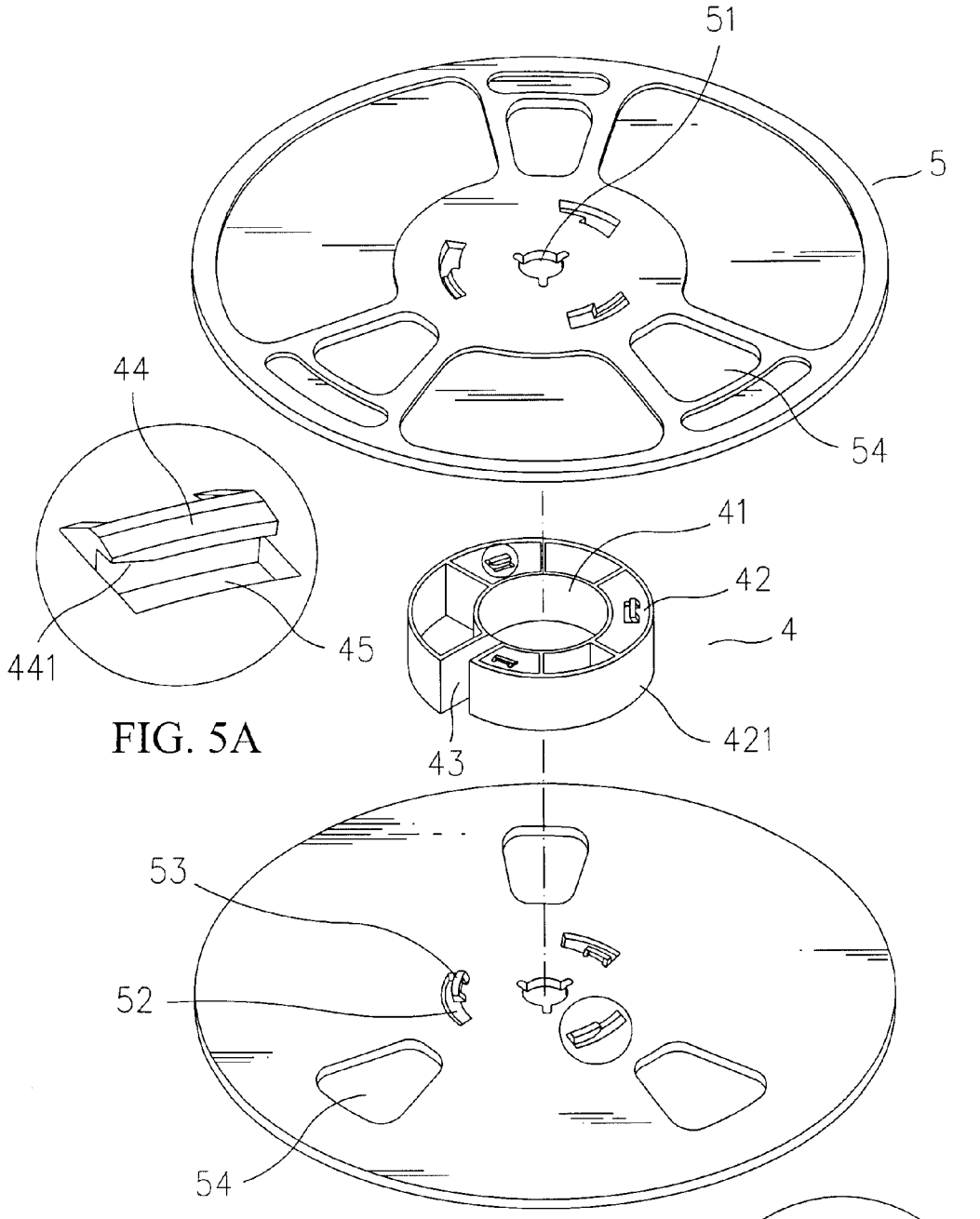
FIG. 5A
FIG. 5
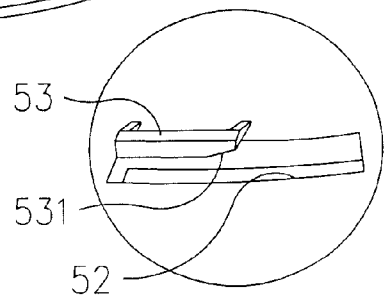
FIG. 5B

LOADING WHEEL FOR INTEGRATED CIRCUIT PACKING BAND

BACKGROUND OF THE INVENTION a) Technical Field of the Invention

The present invention relates to a loading wheel for integrated circular packing band, wherein a wheel body is combined with two side plates and is of different width to accommodate integrated circular packing band.

b) Description of the Prior Art

In order to provide convenient transportation of integrated circuits (IC), the integrated circuits 1 are packed in a loading band 2 as shown in FIG. 1. The packing band 2 is wound around a loading wheel 3, as shown in FIG. 2, which includes a shaft wheel 31 mounted at the ends thereof and a disc plate 32 of larger diameter. The packing band 2 is wound around the shaft wheel 31. Thus, the disc plate 32 is used to protect the packing band 2 to avoid the integrated circuits being damaged. In combination of the integrated circuits, the loading wheel 3 is mounted onto a side shaft and the packing band 2 is pulled out by rotating the loading wheel. The individual IC is exposed so that a robotic arm can pick up the IC for treatment. In this conventional loading wheel 3, the shape and size are fixed, i.e. the size is only fixed for certain packing band having the same width as that of the loading wheel 3. However, the width of the packing band is not always the same. They are varied in width. Thus, various sizes of loading wheels have to be prepared for the integrated circuit. This will increase the cost of storage. In addition, the transportation of the loading wheels is not convenient as they occupy a larger space.

SUMMARY OF THE INVENTION

Accordingly, it is an object of the present invention to provide a loading wheel for integrated circuit packing band, wherein the wheel body can be varied for the engagement with the side plates.

Yet another object of the loading wheel for integrated circuit packing band, wherein the loading wheel is formed from a wheel body and side plates, and the side plates can be stacked to save space and to provide convenient transportation and storage.

Other objects, features and advantages of the invention will be apparent from the following description when read with reference to the accompanying drawings.

BRIEF DESCRIPTION OF THE DRAWINGS

FIG. 5 is a perspective exploded view of a preferred embodiment of the present invention.

FIG. 5A is an enlarged fragmentary view of a portion of FIG. 5.

FIG. 5B is an enlarged fragmentary view of another portion of FIG. 5.

DETAILED DESCRIPTION OF THE PREFERRED EMBODIMENT

Figure 1:
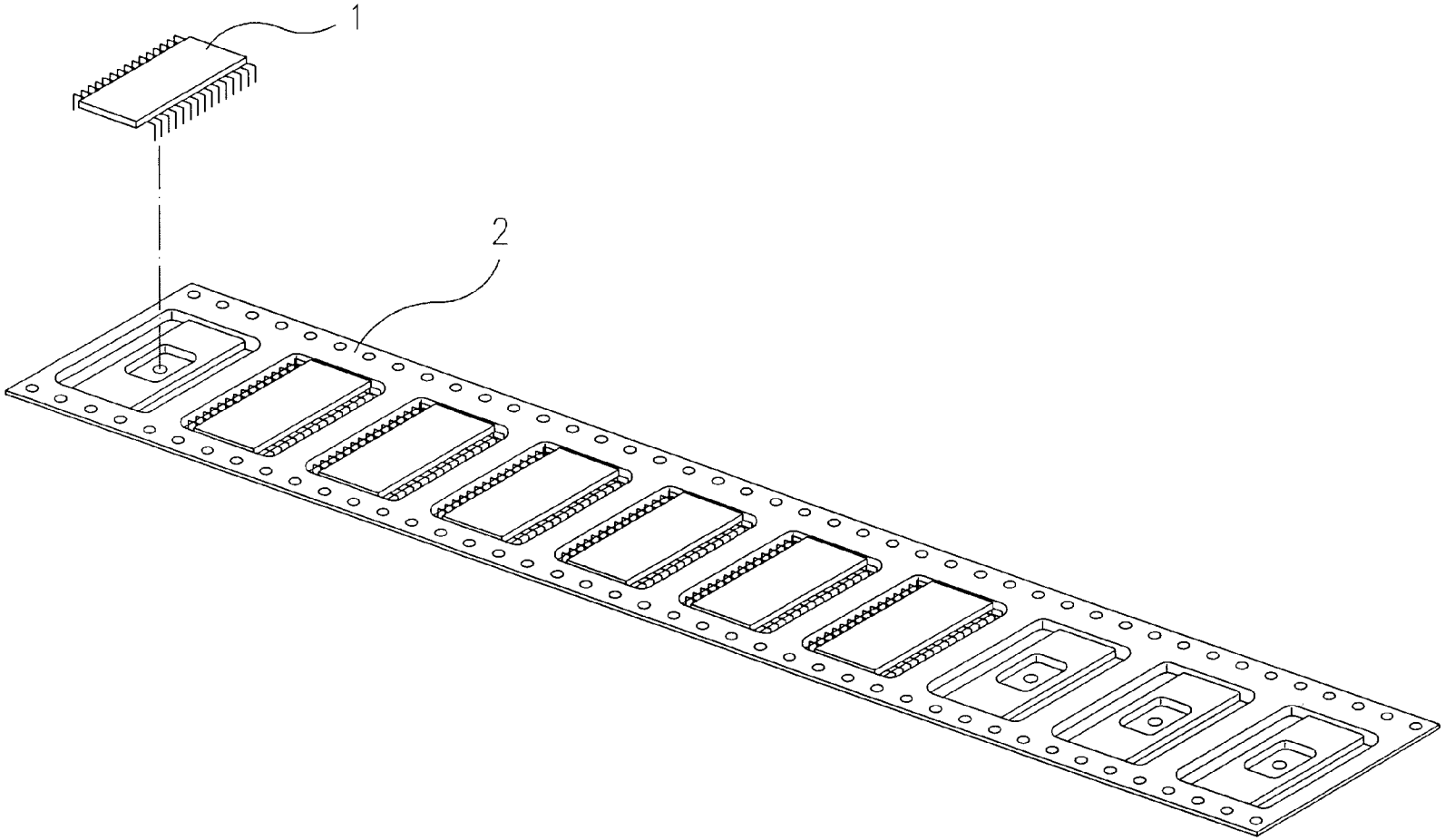
PRIOR ART FIG. 1
FIG. 1 is a perspective view of a conventional integrated circuit (IC) packing band.
Figure 2:
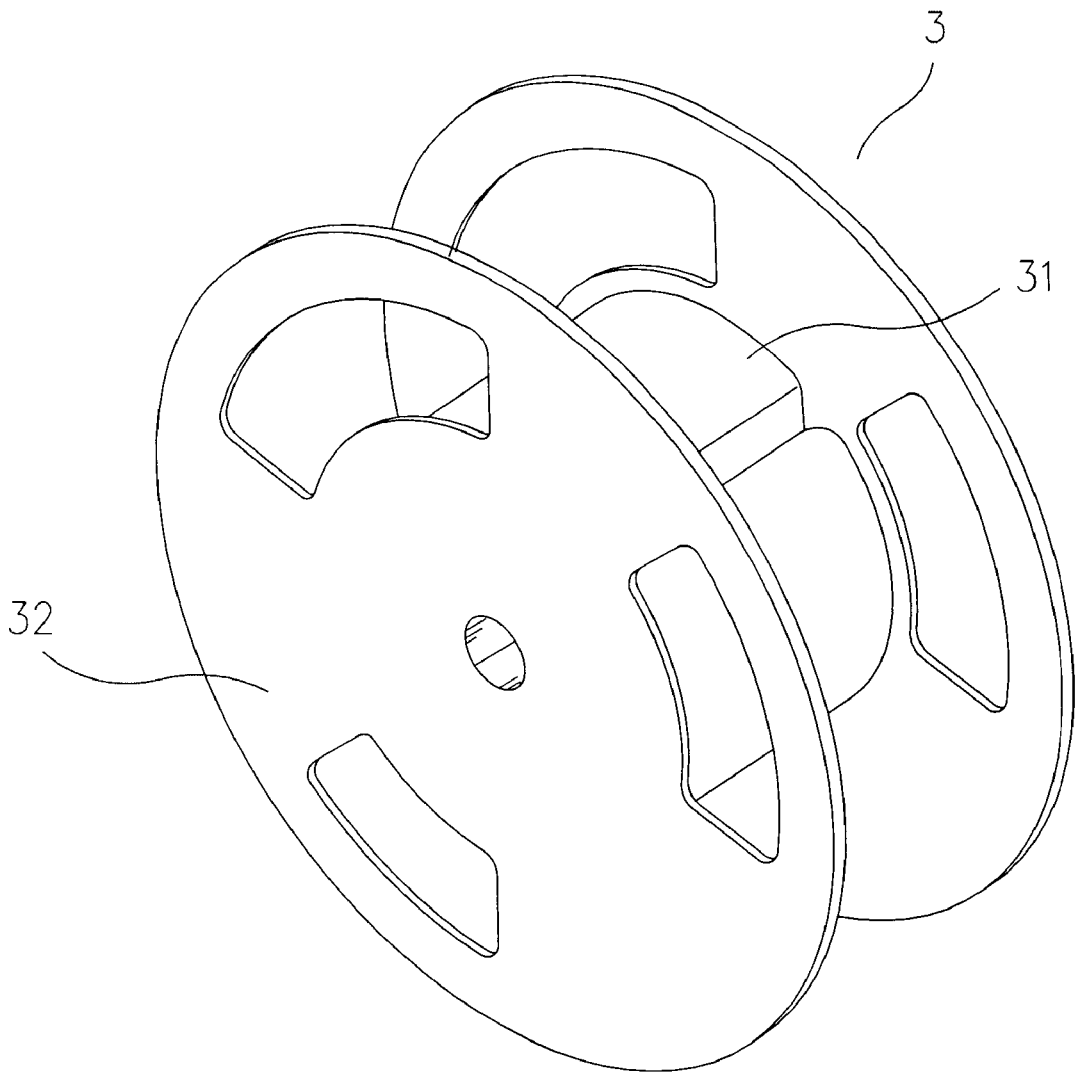
PRIOR ART FIG. 2
FIG. 2 is a perspective view of a conventional loading wheel.
Figure 3:
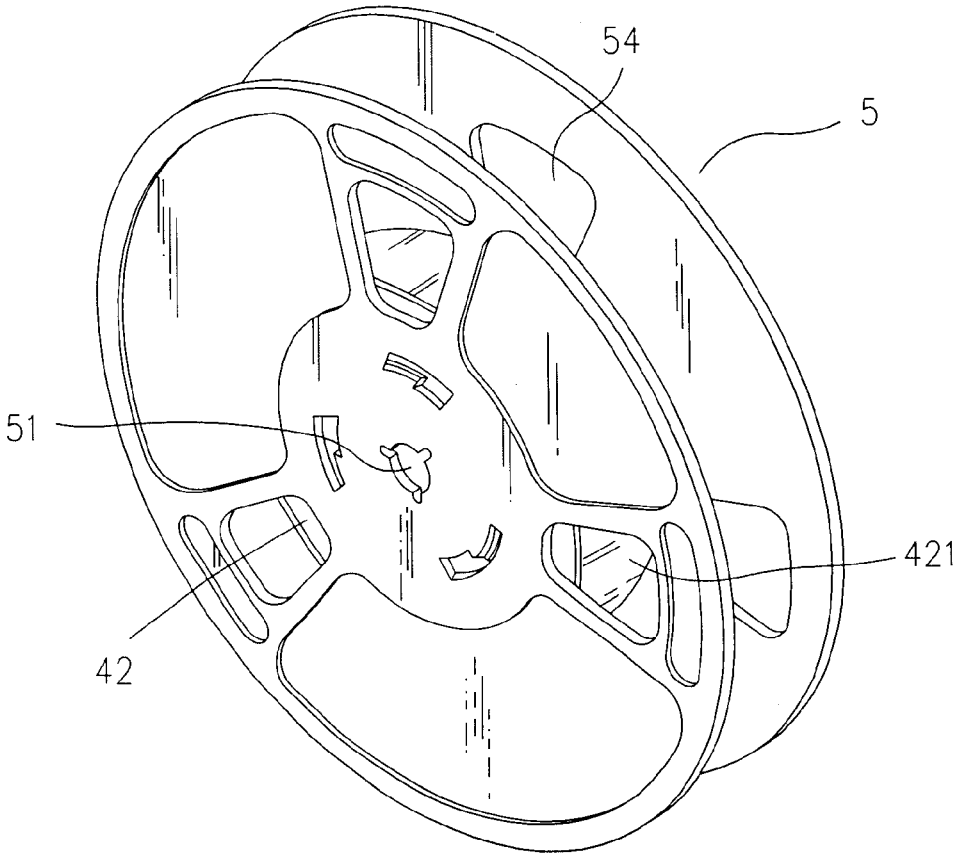
FIG. 3 is a perspective view of a preferred embodiment of the present invention.
Figure 4:
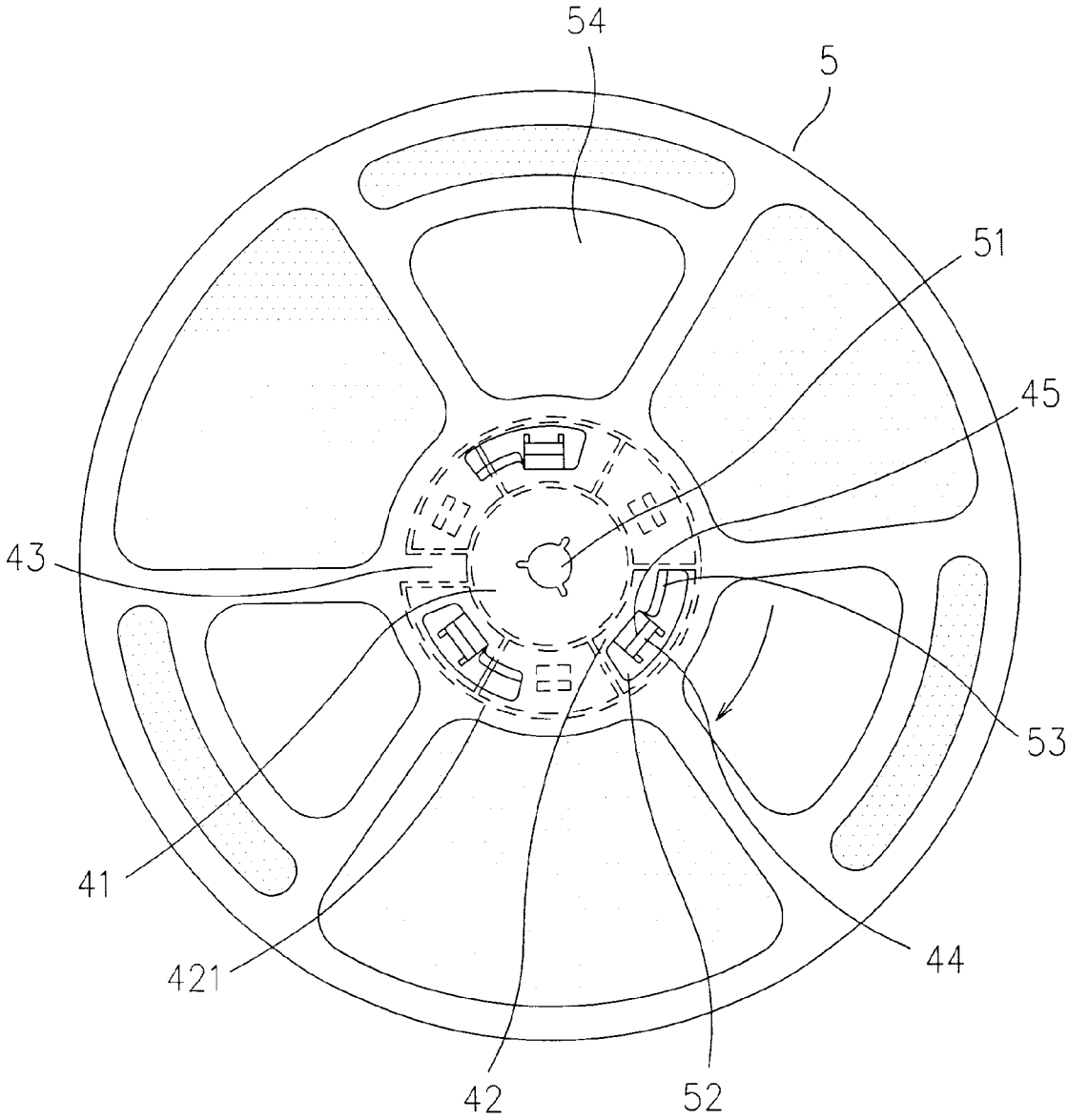
FIG. 4 is a top view of the preferred embodiment of FIG. 3 of the present invention.

Referring to FIGS. 3, 4 and 5, the loading wheel of the present invention comprises a wheel body 4 and two side plates 5 engaged at the two ends of the wheel body 4. The two side plates 5 are identical in shape and structure, and one side plate 5 is described hereinafter. As shown in the figure, the wheel body 4 has a shaft tube 41 surrounded by a plurality of segments 42, and a passage 421 is provided along the circumference of the shaft tube 41. A clipping slot 43 is formed between, two segments 42 for the mounting of the end section of a packing band for winding.

A plurality of protruded engaging blocks 44 are provided in circular along the lateral surface of the individual segments 42. The external edge of the engaging block 44 has a hook-like body having one end being an inverted corner 441. The inner edge of the individual engaging block 44 is provided with a mounting slot 45.

In accordance with the present invention, the side plate 5 is a circular body having a center hole 51 surrounded substantially by a plurality of engaging slots 52. The engaging slots 52 are corresponding to the engaging block 44 of the wheel body 4, and the width of the engaging slot 52 is larger than the engaging block 44. One side of the engaging slot 52 is provided with a protruded block 53 having a hook-like body at the inner side end surface. The end head of the engaging block 53 has an inverted corner 531, which corresponds to the inverted corner 441 of the engaging block 44. At the surrounding of the engaging slot 52, a plurality of through holes 54 are made so as to save material in making the side plates 5 in order to lower the cost of production.

Figure 6:
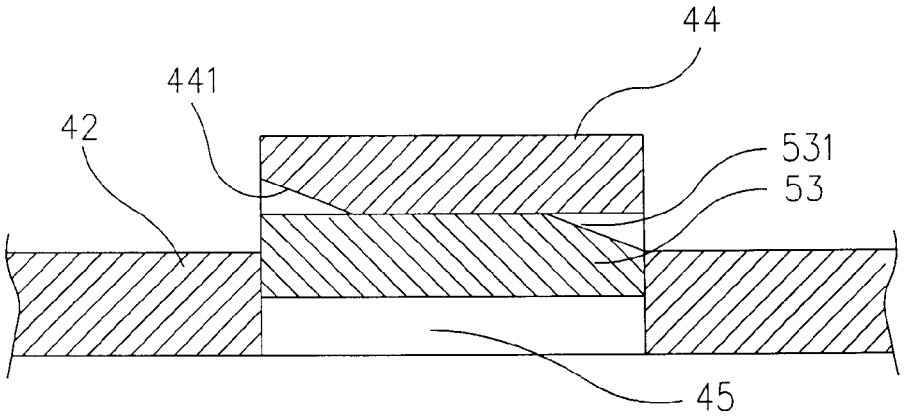
FIG. 6 is a sectional view of the loading wheel in accordance with the present invention.

Referring to FIG. 6, in combination, the side plate 5 is mounted onto the wheel body 4 by aligning the mounting slot 52 (with no mounting block 53) with the mounting block 44 of the wheel body 4 such that the mounting block 44 is inserted into the mounting slot 52. Next, rotating the side plate 5 against the wheel body 4 with force such that the mounting block 53 at the other end of the engaging slot 52 moves to the engaging block 44 of the wheel body 4. Due to the inverted corner 531 provided at the end head of the mounting block 53, a corresponding inverted corner 441 is also provided at the corresponding end of the mounting block 44. The mounting block 53 can be easily engaged with the corner 441, and a portion of the mounting block 53 is engaged with the mounting slot 45 at the inner edge of the engaging block 44. The external face of the engaging block 44 is hooked to the flat surface at the inner end of the mounting block 53 such that the wheel body 4 and the side plates 5 are mounted and secured together. In accordance with the present invention, its combination is convenient. As a partial of the mounting block 53 is in engagement with the mounting slot 45, the side plate 5 will not dislocate from the wheel body 4. However, by rotating the side plate 5 against the wheel body 4 in an opposite direction as that during the combination of the side plate 5 and the wheel body, the engaging block 44 is dislocated from the mounting block 53 and thus the side plate 5 can be dislocated from the wheel body 4.

Figure 7:
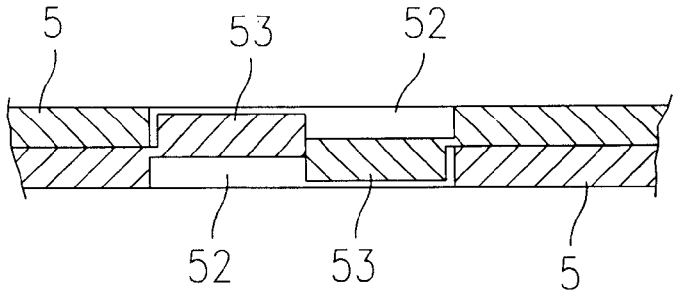
FIG. 7 is a schematic view showing the side plates stacked together in accordance with the present invention.
Figure 8:
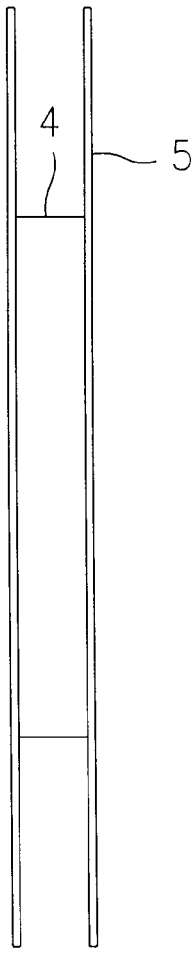
FIG. 8 is a schematic view of a narrower loading wheel in accordance with the present invention.
Figure 9:
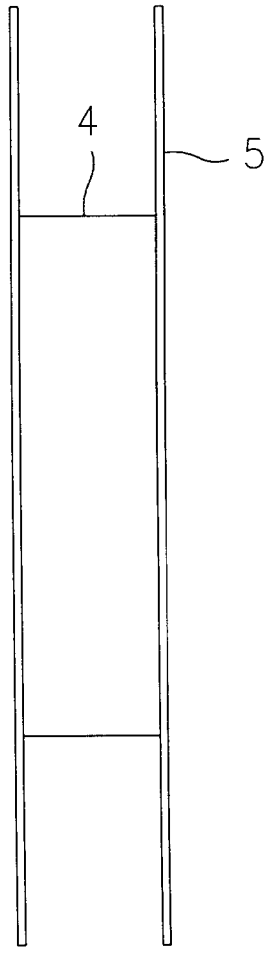
FIG. 9 is a schematic view of a wider loading wheel in accordance with the present invention.

As shown in FIG. 7, two sides plates 5 can be stacked together such that the engaging slot 52 on one side plate 5 can mount onto the mounting block 53. Thus, a larger space for storing is not required. In addition, the width of the wheel body 4 is of various sizes to accommodate IC packing band of various widths, as shown in FIG. 8, a narrower wheel body 4 is required for IC packing band of narrower size. FIG. 9 is a loading wheel for IC packing band of wider size.

While the invention has been described with respect to a preferred embodiment, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A loading wheel for an Integrated Circuit (IC) packing band having a wheel body and two side plates engaged with two ends of said wheel body, wherein a plurality of protruded engaging blocks are provided in circular along lateral surface of the wheel body, an external edge of the engaging blocks is provided with a hook-like body with an inverted corner, an inner edge of the engaging block is provided with a mounting slot, and the side plates are each a circular-shaped body having a center hole substantially surrounded by a plurality of engaging slots corresponding to the engaging blocks, the width of the engaging slot is larger than the engaging block, and one lateral side of the engaging slot is provided with a mounting block, an inner side edge of the mounting block has a hook-like body, and an end head of the mounting block has an inverted corner, thereby the mounting block at the engaging slot of the side plate is engageable with the engaging block of the wheel body forming the loading wheel.

* * * * *